United States Patent [19]

Miles, Sr. et al.

[11] 4,089,290

[45] May 16, 1978

[54] ADJUSTABLE HEIGHT OUTBOARD MOTOR MOUNTING

[76] Inventors: Denny Herschel Miles, Sr., Rte. 3; Larry Willis Miles, Sr., 400 Plum St.; Jewell Willis Miles, Douglas Hwy., all of Hazlehurst, Ga. 31539

[21] Appl. No.: 795,586

[22] Filed: May 10, 1977

[51] Int. Cl.[2] ..... B63H 5/12

[52] U.S. Cl. ..... 115/41 R; 248/4

[58] Field of Search ..... 115/17, 41, 18 R; 248/4

[56] References Cited

U.S. PATENT DOCUMENTS

| | | | |
|---|---|---|---|
| 2,638,863 | 5/1953 | Kiebler et al. | 115/41 R X |
| 2,908,242 | 10/1959 | Forbes et al. | 115/41 R |

*Primary Examiner*—Trygve M. Blix
*Assistant Examiner*—Sherman D. Basinger
*Attorney, Agent, or Firm*—Dowell & Dowell

[57] ABSTRACT

An adjustable outboard motor mounting to be secured to the transom of a boat and support the mounting brackets of a motor, the device having a flanged plate slidable up and down the transom in channeled guides, and having spaced hydraulic piston and cylinder rams operatively mounted between upper and lower brackets, the lower brackets being fixed to the guides and the transom, and the upper brackets, the plate, and the motor brackets being secured together for unitary motion, the hydraulic rams lying in a plane parallel to the transom and located between the transom and the center of gravity of the motor.

4 Claims, 6 Drawing Figures

FIG. 4.
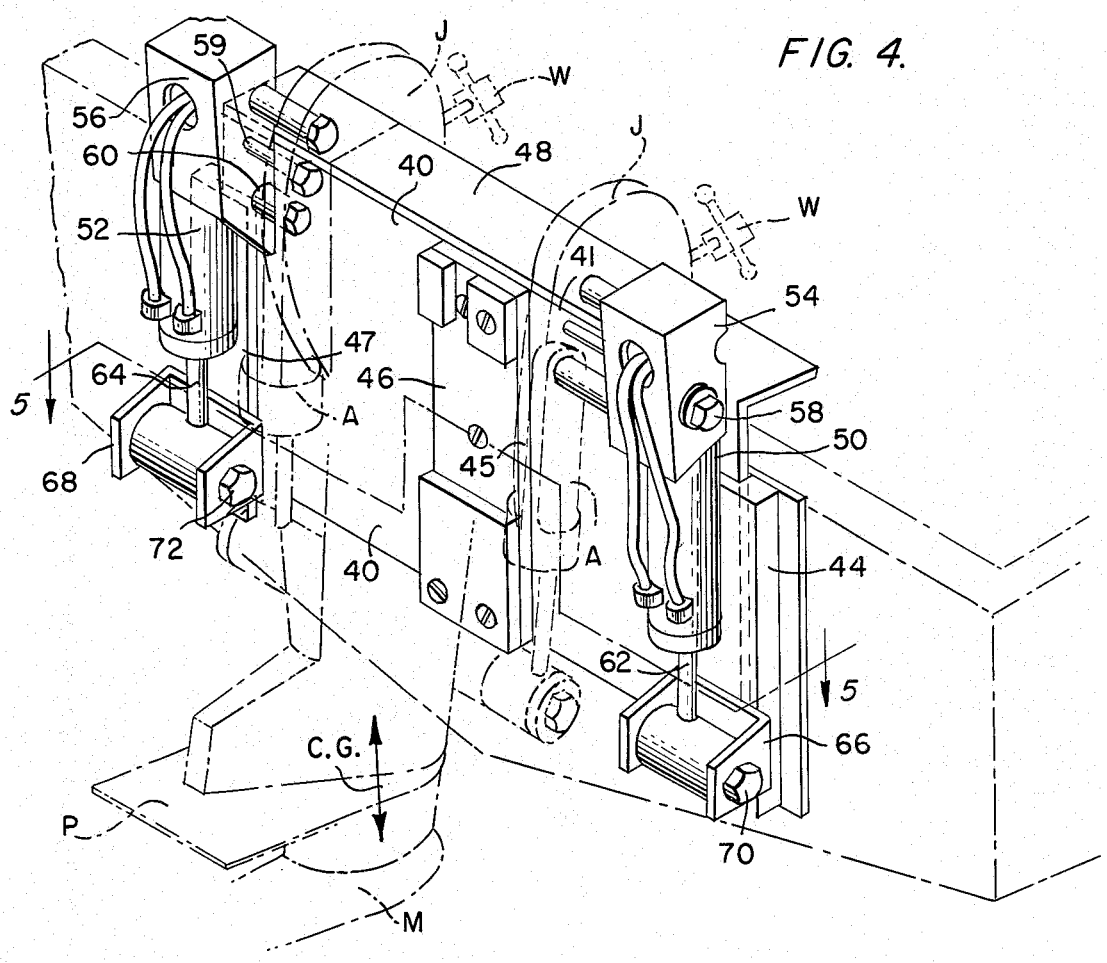
FIG. 5.
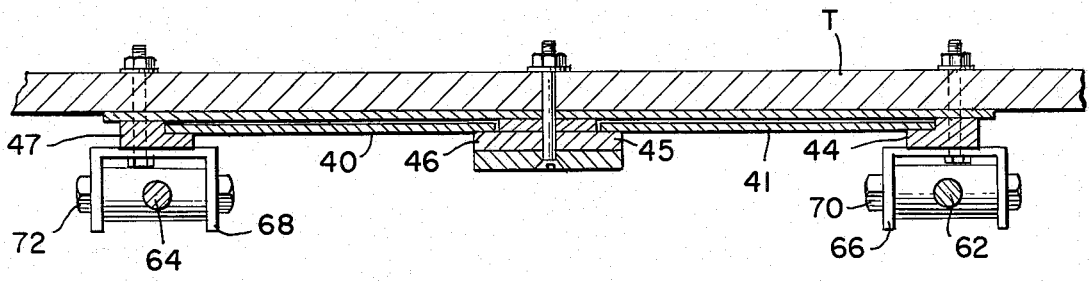
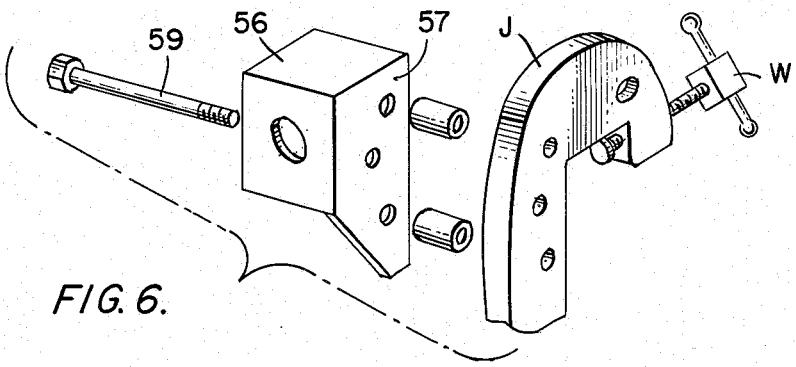
FIG. 6.

ADJUSTABLE HEIGHT OUTBOARD MOTOR MOUNTING

FIELD OF INVENTION

This invention relates to means for mounting an outboard motor on the transom of a boat, and more particularly relates to mounting means which is hydraulically actuated to change the elevation of the outboard motor relative to the bottom of the boat while the motor is driving the boat in order to achieve an optimum trim of the motor height-wise for the particular speed at which the boat is being driven and for the existing loading and load distribution within the boat.

BACKGROUND AND PRIOR ART

It has been recognized for some years that it is very desirable to be able to change the elevation of the lower unit of an outboard motor mounted on a boat, not only to permit the propeller to avoid striking submerged obstructions and to permit the boat to be propelled through shallow water, but also to adjust the operating elevation of the propeller relative to the bottom of the boat to achieve optimum drive efficiency for a particular boat, speed and loading thereof. As outboard motors have become heavier, power assist devices have been included in the mounting, as taught for instance by U.S. Pat. No. 3,096,959 to Wagner and U.S. Pat. No. 3,107,074 to Fowler.

U.S. Pat. No. 3,809,343 to Adams shows an hydraulic cylinder and telescoping guide means which is not intended to make elevation adjustments to improve operating trim at cruising speeds, but instead serves the purpose of simultaneously elevating the entire motor with respect to the transom and also tilting it into a storage position in which the lower unit of the motor is well clear of the water.

U.S. Pat. No. 3,421,723 to Holt provides an hydraulic adjustable-height mounting which straddles the transom of the boat for the purpose of avoiding the necessity of drilling any mounting holes through the transom. U.S. Pat. No. 2,775,219 to Curtis also shows a mounting which straddles the transom. Both of these patents show slide means aft of the transom and hydraulic cylinders inside the boat forward of the transom for elevating the slide means which carries the motor.

THE INVENTION

The present invention provides an improved adjustable height outboard motor mounting which mounts upon the transom of a boat, and which places all of the parts of the adjustable mounting on the aft or outside surface of the transom so that the mount can be used on a boat having a stern seat or deck structure which would make the inside surface of the transom inaccessible. The mounting of the present invention comprises a plurality of vertical guide members which are bolted to the transom and which leave a space between them occupied by a vertically oriented motor-supporting plate member which slides in channels in the guide members. Each end of the mounting has an hydraulic cylinder and piston type ram vertically oriented and connected at its lower end to a bracket which is bolted to the guide member near its lower end and is stationary therewith. Each ram is pivotally connected at its upper end to an upper bracket, which in turn is secured either to the motor support plate member of alternatively to the adjacent mounting bracket of the outboard motor which is mounted on the plate member, whereby the hydraulic rams function to adjust the elevation of the plate member and the outboard motor supported thereon.

It is a principal object of the invention to provide a heavy duty outboard motor mounting which is adjustable in height by ram means, and which is sturdy enough so that it can support very large outboard motors, for instance motors over 100 horsepower weighing 250 to 350 pounds, and which can be adjusted up and down while the boat is being driven at operating speeds by the outboard motor.

It is an object of the invention to provide a motor mounting which can be adjusted for the purpose of trimming the position of the motor to a transom elevation which provides optimum efficiency in the speed and/or maneuverability of the boat. The way to achieve this purpose is to adjust the elevation of the mounting while the motor and the boat are performing at the selected speed so that speeds can be compared for various changes in the height adjustment, for instance by using a tachometer to measure the r.p.m. of the motor, or by using a marine speedometer to measure the velocity of the boat through the water. The above-mentioned prior art motor mounting brackets provide the capability of adjusting the height of the motor, but only while the boat is either standing still or being driven at a relatively low speed. This being the case, prior art brackets are mainly useful for the purpose of positioning the top of the propeller in the vicinity of the bottom of the transom.

It is another important object of the invention to provide a mounting bracket of the type specified in which all of the parts are located adjacent to the outside aft surface of the transom and none of the parts are located inside of the transom, whereby a motor can be mounted on a boat having a stern seat or deck structure which makes the inside of the transom partly inaccessible.

It is a further object of the invention to provide an outboard motor mounting which has a plate member slidable in guide members bolted to the transom in such a way that they reinforce the transom. Since the present mounting is intended to be used with very large outboard motors, it is important that the transom be reinforced by the mounting.

Still another object of the invention is to provide a motor mounting having at the boat transom a vertically slidable plate member which mounts the motor, and having hydraulic height adjustment rams mounted for moving the plate member and the motor itself up and down, the rams being located between the plate member and the center of gravity of the motor, whereby the vertical lift provided by each hydraulic ram is located nearer to a balance point between the center of gravity of the motor and the frictional drag of the plate on the transom than would be the case of a mounting, for instance, of the type shown in the above mentioned patents to Holt and Curtis, i.e. where the hydraulic rams are located inside of the transom with both the drag of the plate member and the weight of the motor offset on the same side, i.e. aft of the rams. By placing the rams outside of the transom between the motor and the plate member, they provide a lifting force near the center of gravity of the motor, thereby producing less binding of the plate means in the vertical guides due to the tendency of the plate to cock in those guides. It is important to provide a mounting wherein the hydraulic rams are located between the vertical plate member on the one hand, and the center of gravity of the motor on the other hand, since the forces which must be delivered by the hydraulic rams in order to raise the motor and plate member during high speed operation thereof will tend to mutually balance out to a considerable extent, i.e. by the weight of the motor resisting upward thrust to the rear of the rams, and by frictional force forward of the rams tending to drag the mounting plate against the transom and thereby resist upward thrust due to pressure of the plate against the transom caused by the motor pushing it forward. The drag of the plate due to the forward thrust of the motor is a factor that did not have to be considered by Holt or Curtis in their mountings because it was not their intention that the motor height should be changed during high speed operation.

Another object of the invention is to provide an adjustable height outboard motor mounting in which the two elevating hydraulic cylinders are located at the outermost guides in which the motor supporting plate is vertically slidable, whereby the elevating cylinders are far enough apart to leave adequate space between them for motors having hydraulic tilting cylinders, or having hydraulic shock absorbers of the type which appear on larger motors.

Still another object of the invention is to provide an adjustable height motor mounting adapted to permit the support bracket of an outboard motor to be screwed to the plate by flat head screws which pass through the plate and also through the motor mounting. This bolting technique is used frequently in the mounting of larger size outboard motors to ensure that they will be securely attached to the boat.

Other objects and advantages of the invention will become apparent during the following discussion of the drawings:

THE DRAWINGS

FIG. 4 is a perspective view of a modified form of the invention;

FIG. 5 is a sectional view taken along line 5—5 of FIG. 4; and

FIG. 6 is an enlarged exploded detail view of the left upper bracket and motor mounting bracket assembly illustrated in FIG. 4.

Figure 1:
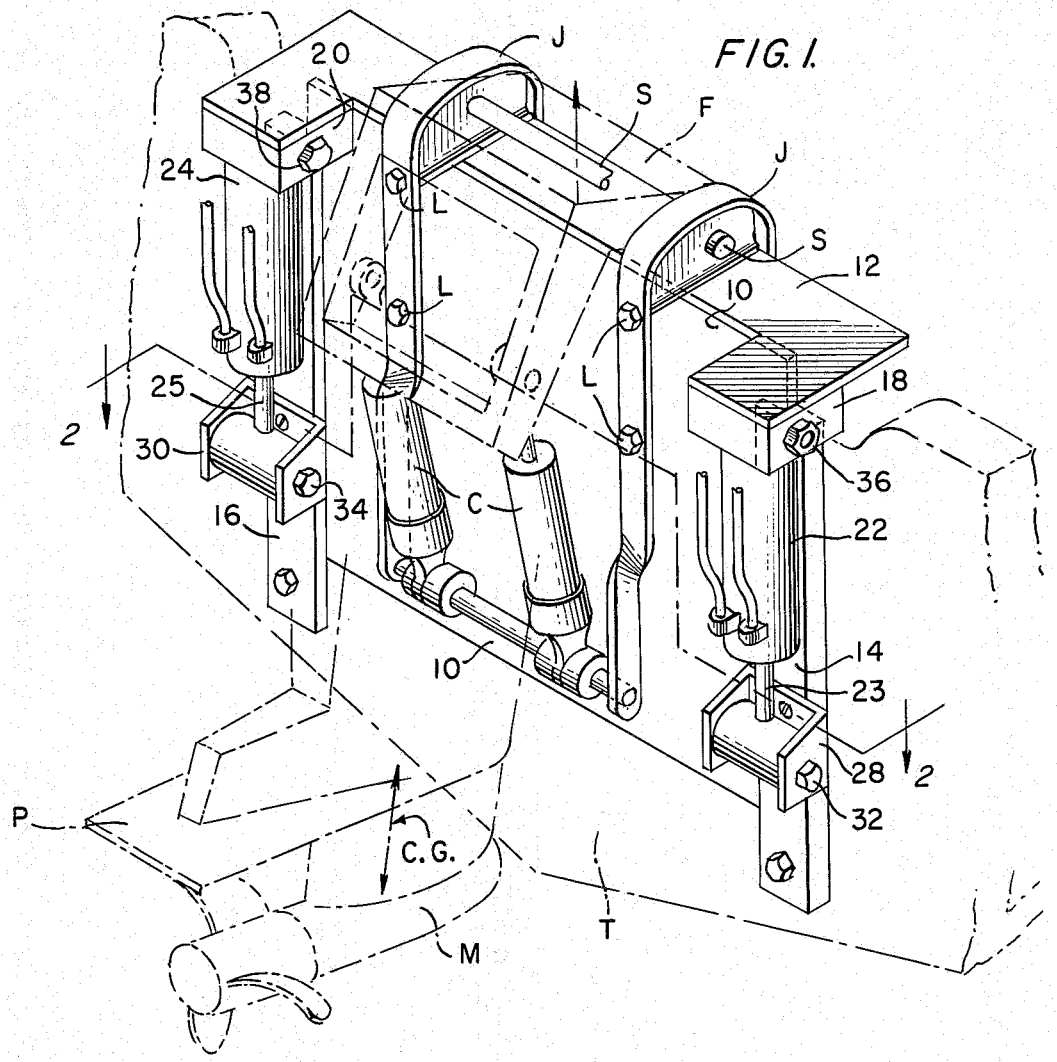
FIG. 1 is a perspective view of an adjustable height outboard motor mounting according to the present invention.
Figure 2:
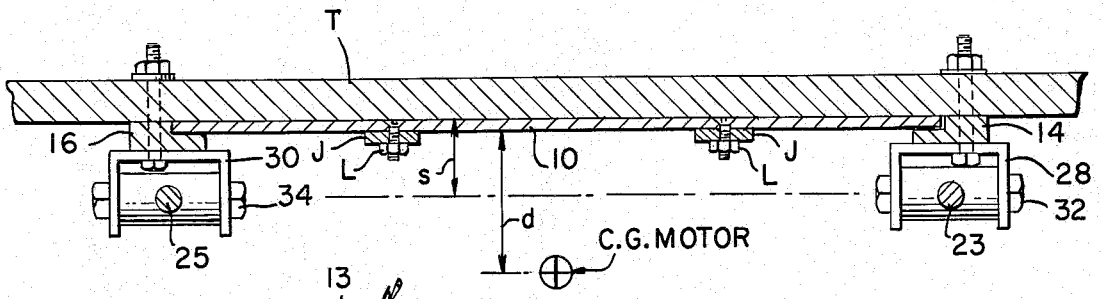
FIG. 2 is a sectional view taken along line 2—2 of FIG. 1.

Referring now to the drawings, and particularly to FIGS. 1 and 2, FIG. 1 shows the transom T of a boat in dashed lines. The transom has outboard motor mounting J-brackets J bolted thereto by fasteners L, which brackets J in turn support an outboard motor M which is partly shown in dashed lines and has a vertical center of gravity C.G. The portions of the motor which are illustrated include the two power-tilt cylinders C which are factory-mounted on some larger outboard motors, and are illustrated herein only for the sake of showing structure of a large outboard motor as purchased. The J-brackets have a shaft S forming a pivot which horizontally pivots a frame F which in turn supports the motor itself. The motor swivels vertically about a bearing (not shown) supported in the frame F in a manner well known per se for steering purposes, and the frame F tilts about the horizontal shaft S for tilting the lower unit of the motor upwardly. The power tilt hydraulic cylinders C and the lower unit of the motor including the wash plate P are typical of heavy motor construction, resembling for instance current models of the 175 h.p. Mercury outboard motor sold under the name Black Max.

The outboard motor mounting comprising the subject matter of the present disclosure as shown in FIGS. 1 and 2 comprises a heavy metal plate 10, for instance ¼ inch aluminum alloy, which has a flange 12 across the top of it overlying the top of the transom T of the boat. The vertical sides of the plate 10 slide in a pair of guides 14 and 16 which are bolted to the transom T. At the top of the plate on each side thereof is a pivot bracket such as the brackets 18 and 20 supporting the upper ends of hydraulic rams 22 and 24 which are used to raise and lower the plate 10 in channels located in the sides of the guides 14 and 16, FIG. 2. Piston rods 23 and 25 extend downwardly from each of the cylinder portions of the rams 22 and 24, and each terminates in a joint which is pivotally connected to stationary brackets 28 and 30 which are respectively screwed through the guide members 14 and 16 and through the transom. Bolts 32 and 34 pivotally connect the lower ends of the piston rods to these stationary brackets. The upper ends of the rams are secured by pivot bolts 36 and 38 which extend through the brackets 18 and 20. Thus, the cylinder portions of the rams 22 and 24 move up and down to move the motor supporting plate 10 up and down, and the piston rods 23 and 25 and the brackets 28 and 30 stand still and are secured in fixed positions relative to the boat. The outboard motor brackets J hook over the top flange 12 of the plate 10 and are screwed through the plate 10 by suitable securing means L comprising flat head screws on the forward side of the plate 10 and nuts on its aft side, whereby the heads of the screws will not interfere with vertical movements of the plate 10 by rubbing against the transom T.

FIG. 2 shows the vertical center of gravity C.G. of the motor located aft of the transom T and the sliding plate 10 by a distance d which is greater than the spacing s between the piston rods 23 and 25 and the aft side of the transom, thereby placing the thrust of the rams 22 and 24 between the transom T and the center of gravity C.G. of the motor. Although the distance s is equal to about one half the distance d in the drawing, it is to be understood that the ratio $s/d$ can be changed as desired for different parameters such as motor weight and thrust, whereby to achieve an approximate cancellation of turning moments about the plane of the rams 22 and 24 attributable to motor weight on the one hand, and on the other hand the drag of the plate 10 against the transom and channels when the motor is driving the boat and the rams are seeking to raise the plate and motor M.

Figure 3:
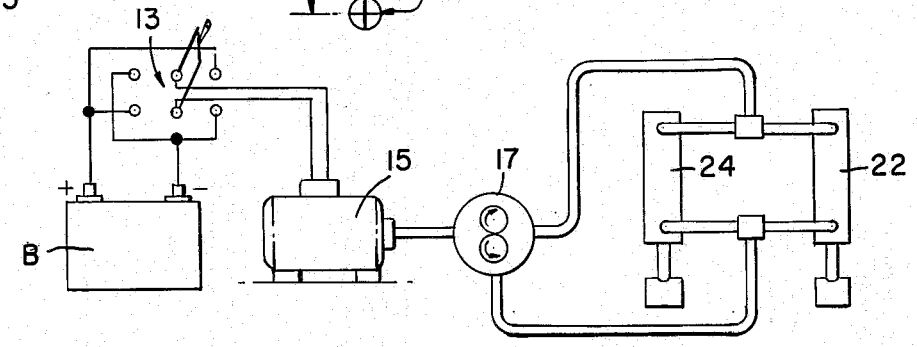
FIG. 3 is a diagram of a reversible hydraulic ram actuating circuit.

FIG. 3 shows an hydraulic ram drive system including a storage battery B connected through a reversing switch 13 to drive a motor 15 which is coupled to drive a positive displacement pump 17. When the switch 13 is open, the rams 22 and 24 are locked at their selected level, because the pump 17 is of the positive displacement type. If the switch 13 is closed in one direction the pump 17 is rotated to drive the rams in one direction. If the switch 13 is reversed, the motor polarity is reversed, and it rotates the pump 17 the other way to drive the rams in the opposite direction, all as well known in the prior art.

Referring now to FIGS. 4, 5, and 6, these views also show a motor mount secured to the transom T of a boat to which a motor M is mounted by J-shaped brackets J comprising part of the motor. The brackets can be secured to the plate by any suitable means such for instance as wing nuts W which screw against the forward side of the plate in the manner well known in the prior art. In this modification, the mounting of the invention comprises two plates 40 and 41 which are mounted in four channeled guides 44, 45, 46, and 47, as can best be seen in FIG. 5, the guides being held on the transom by bolts. The plates 40 and 41 are joined together at their tops above the upper ends of the guides 45 and 46 and are then provided with a forward facing flange 48. Thus, the fact that the plates 40 and 41 are divided vertically below their tops provides in their central portion a slot for running in the channels of the guides 45 and 46 to achieve a stronger and better guided structure.

The motor brackets J are used to support the upper ends of the hydraulic rams 50 and 52 using a pair of upper ram brackets 54 and 56 which are secured to the upper end of each of the rams 50 and 52 by pivot bolts 58 and 59. These bolts pass through a fitting in the end of the ram and through both sides of the bracket such as the side 57 of the bracket 56. As can be seen on the left bracket 56, each mounting plate 57 has three holes in it by which it is bolted to the J-bracket J of the motor. Thus, one important feature of difference of the modification of FIG. 4 is that the brackets 54 and 56 which secure the upper ends of the elevating rams 50 and 52 are not mounted to the plates 40 and 41, but instead are mounted directly to the motor brackets J by three bolts. A piston rod 62 and 64 extends down from each ram and terminates at a fitting within a stationary bracket 66 or 68 in which it is captivated by a through-bolt 70 or 72.

As in the case of the first embodiment of the invention, the piston rods 62 and 64 and the brackets 66 and 68 stand still and are secured to the transom of the boat, whereas, the upper brackets 54 and 56 and the rams 50 and 52 travel up and down in order to move the plates 40 and 41 and the motor brackets J up and down with them.

As is the case with the form of the invention shown in FIG. 1, the rams 50 and 52 are located roughly mid-way between the center of gravity of the engine which is behind the rams and the frictional drag of the plates 40 and 41 against the transom. This drag is quite great when the engine is being run at high speed, which is the precise circumstance under which the operator of the engine will wish to make elevational adjustments by raising and lowering the motor with respect to the transom.

The outline of the motor shown in FIG. 4 is somewhat different from the motor shown in FIG. 1. In FIG. 4, there are no power-tilt cylinders C, but instead two shock absorbers A are illustrated which are factory supplied equipment on some motors. The shock absorbers A extend from fittings fixed on the lower drive unit of the motor to the J-brackets of the motor to which they are pivoted at their upper ends. The shock absorbers cushion the return of the motor to vertical position after it has been kicked to a tilted position by striking an object in the water or grounding.

In both embodiments of the invention, the same hydraulic system as shown in FIG. 3 can be used to drive the elevating rams in unison.

This invention is not to be limited to the exact embodiments shown in the drawings for obviously changes may be made therein within the scope of the following claims.

We claim:

1. An adjustable height outboard motor mounting to be secured to the transom of a boat and support the mounting brackets of the motor, comprising:

a. a plate overlying the outer surface of the transom and having means cooperating with the motor mounting brackets and securing them to the plate;

b. upright guide means fixed to the transom parallel to the side edges of the plate and having channels receiving said edges to guide vertical sliding of the plate;

c. a lower bracket fixed to each guide means near its bottom;

d. an upper bracket spaced above each lower bracket, said plate having a flange at its upper edge and overlying the top of the transom, and the flange extending aft of the plate near the sides thereof above said lower brackets, and each upper bracket secured to the plate and to a portion of the flange extending aft thereof; and e. power operated hydraulic ram means including a piston and cylinder means mounted between each upper and lower bracket, each piston and cylinder means being located in a plane passing between the plate and the motor, whereby the weight of the motor is aft of the piston and cylinder means and the drag of the plate against the transom due to friction and motor thrust is forward of the piston and cylinder means.

2. An adjustable height outboard motor mounting to be secured to the transom of a boat and support the mounting brackets of the motor, comprising:

a. a plate overlying the outer surface of the transom and having means cooperating with the motor mounting brackets and securing them to the plate;

b. upright guide means fixed to the transom parallel to the side edges of the plate and having channels receiving said edges to guide vertical sliding of the plate;

c. a lower bracket fixed to each guide means near its bottom;

d. an upper bracket spaced above each lower bracket;

e. means for securing together for unitary vertical movement each upper bracket and the plate and one of the motor brackets, said means for securing comprising means for securing each motor bracket to the plate, and means for securing each upper bracket to one of the motor brackets; and f. power operated hydraulic ram means including a piston and cylinder means mounted between each upper and lower bracket, each piston and cylinder means being located in a plane passing between the plate and the motor, whereby the weight of the motor is aft of the piston and cylinder means and the drag of the plate against the transom due to friction and motor thrust is forward of the piston and cylinder means.

3. In an outboard mounting as set forth in claim 1, said plate being divided vertically in its central portion to provide a vertical slot, and said upright guide means including guide means fixed to the transom at the central portion of the plate and having channels to receive the central slot of the plate to guide it for vertical sliding.

4. In an outboard mounting as set forth in claim 3, said plate having a flange extending all the way across its upper edge and extending forwardly of the plate over the upper edge of the transom, the flange being integrally connected with the plate and reinforcing the plate above the slot.

* * * * *